United States Patent [19]

Morishita et al.

[11] 4,047,514

[45] Sept. 13, 1977

[54] FURNACE TAPHOLE DRILLING BIT

[75] Inventors: Tsuyoshi Morishita; Kenji Miyake; Noboru Ishii, all of Hiroshima; Toshikazu Wakigara, Kure; Naoji Ueda, Hiroshima, all of Japan

[73] Assignee: Toyo Kogyo Co., Ltd., Hiroshima, Japan

[21] Appl. No.: 731,821

[22] Filed: Oct. 12, 1976

[51] Int. Cl.[2] ..... B28D 1/26

[52] U.S. Cl. ..... 125/40; 76/108 A

[58] Field of Search ..... 228/263; 125/40; 76/108 A

[56] References Cited

U.S. PATENT DOCUMENTS

| | | | |
|---|---|---|---|
| 1,701,427 | 2/1929 | Shields | 76/108 A |
| 2,867,137 | 1/1959 | Joy | 125/40 X |
| 2,995,815 | 8/1961 | Dixon | 228/263 |
| 3,056,196 | 10/1962 | Berg | 228/263 |
| 3,894,676 | 7/1975 | Oppenheim | 228/263 |

*Primary Examiner*—Harold D. Whitehead

*Attorney, Agent, or Firm*—Wenderoth, Link & Ponack

[57] ABSTRACT

A drilling bit for use in making a taphole in a blast furnace. The drilling bit has a bit head having a plurality of cutting tips radially arranged on and soldered to the bit head. Soldering of the tips to the bit head is carried out by the use of a soldering material of a particular composition containing 3 to 5% by weight of carbon, 0.5 to 3.0% by weight of silicon and the balance iron, the sum of the carbon content and the silicon content in the composition being at least 4% by weight relative to the total weight of the composition. Each of the tips which are to be soldered to the bit head by the use of the particular soldering material is made of either stellite or a super hard alloy.

7 Claims, 6 Drawing Figures

FURNACE TAPHOLE DRILLING BIT

BACKGROUND OF THE INVENTION

The present invention generally relates to a drilling machine for making a taphole in a furnace and, more particularly, to a drilling bit for use in the furnace taphole drilling machine.

It is well known to those skilled in the art that a taphole at or near the bottom of a blast furnace is, during the operation of the furnace, during that is, the manufacture of pig iron, closed by a mud material which has been introduced into the taphole in the form of a refractory slurry and which is sintered and, therefore, hardened by the heat evolved in the furnace being operated. Each time molten iron is tapped through the taphole, the thus hardened mud must be removed by the use of, for example, a drilling machine. For this purpose, the drilling machine has heretofore made use of a drilling bit having a bit head provided with cutting tips made of steel.

With the drilling bit having the steel cutting tips, it has been found that, since the mud is hardened as described above, a lot of time is required in making the taphole in the blast furnace with substantial reduction in drilling efficiency.

The Japanese Utility Model Publication (Examined) No. 42811/1975, an unexamined version of which was first laid open to public inspection under No. 110408/1973 on Dec. 19, 1973, discloses a drilling bit having a bit head onto which are welded a plurality of tips made of super hard alloy, the resultant lines of welding being in turn deposited with metal from a welding rod to form a padding. The super hard alloy in the present invention is also called a cemented carbide or a high hardness alloy. As compared with the drilling bit of the first described type, the drilling bit having the construction according to the Japanese Utility Model Publication is satisfactory in its performance. However, some disadvantages have still been found. One of them is that, since the tips are rapidly heated and cooled during the drilling or tapping operation to form the taphole in the blast furnace, these tips are susceptible to cracking. Another disadvantage is that the formation of the padding requires a long time during the manufacture of the ultimate drilling bit. Furthermore, the recent practice to improve the economy and material saving is to reuse the once-used drilling bit after a padding of stellite has been formed on the worn cutting tips. The reuse of the worn drilling bit, however, is difficult partly because of insufficient bondability between the stellite and the super hard alloy and partly because of the formation of an oxidized film on the surface of the padding.

In view of the foregoing, the drilling bit largely employed nowadays in making the taphole in the blast furnace has a construction manufactured by depositing stellite on the bit head to form a stellite padding and then grinding the stellite padding to provide a sharp cutting edge. With the drilling bit, once the cutting edge wears, the bit can be reused by re-depositing stellite on the worn cutting edge and then grinding the re-deposited stellite padding to form the cutting edge. However, this technique has been found to require a lot of time, and a relatively large amount of material for making the padding and in the preparation resulting in an increased processing cost.

Moreover, the yield of the material used for the padding is relatively so low which results in a increased cost of the drilling operation.

Alternatively, it is possible to use a drilling bit having tips made of either stellite or a super hard alloy composed of tungsten carbide and cobalt, which tips are soldered to the bit heat. However, where the solder for connecting the tips to the bit head is employed is a silver or copper solder which is generally used in making a drilling bit for use in a rock drilling machine, the solder tends to be melted, when such a drilling bit is used in drilling the taphole in a blast furnace, with the consequent separation of some or all of the tips from the bit head, since the drilling bit is heated to a temperature more than 1,100° C. during the tapping operation. In view of this, such a drilling bit cannot practically be used in the preparation of the taphole in the blast furnace.

SUMMARY OF THE INVENTION

Accordingly, we have, after a series of research and development efforts in connection with the drilling bit intended for use in which a taphole in the blast furnace, found that a solder for connecting the tips, made of either stellite or super hard alloy, to the bit head made of a ferrous material such as iron or steel must satisfy the following requirements:

1. The melting point of the solder must be within the range of 1,100° to 1,250° C. If it is not more than 1,100° C., the tips tend to be separated from the bit head for the reason which has already been described. On the other hand, if the solder having a melting point not less than 1,250° C. is employed, both the tips and the bit head are heated to a temperature of about 1,250° C. or so during the soldering operation so that the carbon component contained in the super hard alloy or stellite, which is the material for the tips, may be rapidly diffused into the ferrous material for the bit head with incident melting of a surface portion of the tips and, therefore, the physical strength of the individual tips may be lowered.

2. The solder must provide a sufficient bondability relative to the cutting tips made of either stellite or super hard alloy and also the bit head made of ferrous material such as iron or steel. Where the solder exhibits a relatively low wettability and bondability relative to the cutting tips and also to the bit head, the resultant drilling bit will not have a sufficient resistance to a relatively high impact force and also a relatively high twisting force.

3. The solder must not bring about reduction in the physical properties of the tips such as wear resistance and resistance to impact. If the resistance to impact of the tips is lowered, the tips tend to be readily separated from the bit head.

4. The solder must be of a nature capable of resulting a joint having sufficient wear resistance, impact resistance and damping property. Where the joint formed by the solder fails to have a sufficient wear resistance, the joint will wear more readily than the tips and, therefore, the tips are susceptible to separation from the bit head. Where the joint formed by the solder fails to have a sufficient impact resistance, the joint is susceptible to cracking to such an extent that the tips may ultimately separate from the bit head. Moreover, where the same joint has an insufficient damping property, this may result in formation of a gap between the solder and any one of the cutting tips and the bit head due to plastic deformation which occurs when the drilling bit is repeatedly subjected to a load during the tapping or drilling operation. The gap so formed may be liable to cause separation of the corresponding tip from the bit head. In view of the foregoing, the solder is preferably of a nature capable of resulting in a joint having a Vickers hardness of not less than 150.

According to the present invention, the solder has been found to satisfy all of the foregoing requirements if it is in the form of an alloy of a composition which contains 3 to 5% by weight of carbon, 0.5 to 3.0% by weight of silicon and the balance iron, the sum of the carbon content and the silicon content being at least 4% by weight relative to the total weight of the composition. In other words, an essential feature of the present invention resides in that cutting tips of either stellite or super hard alloy are soldered to the bit head of ferrous material, such as iron or steel, by the use of the solder having a composition containing 3 to 5% by weight of carbon, 0.5 to 3.0% by weight of silicon and the balance iron, the sum of the carbon content and the silicon content being at least 4% by weight relative to the total weight of the composition, thereby providing a drilling bit for use in making the taphole in the furnace.

A carbon component, of the solder according to the present invention, which is an amount within the range of 3 to 5% by weight relative to the total weight of the composition, serves to avoid the diffusion of the carbon component contained in the material for the tips, which may otherwise result in reduction of the hardness of the tips, and also to lower the melting point of the resultant solder and to improve the hardness and, therefore, wear resistance imparted to the joint which is ultimately formed by the solder. If the carbon content is not more than 3% by weight, the melting point of the resultant solder will become high and the amount of the carbon component contained in the material for the tips and diffused into the solder during a soldering operation will become so great that not only will the wear resistance of the tips be reduced, but also the bondability will also be adversely affected. On the contrary thereto, if the carbon content in the composition of the solder according to the present invention is not less than 5% by weight, the carbon component contained in the solder will precipitate during the soldering operation with consequent reduction in wear resistance and bondability of the joint ultimately formed by the solder.

A silicon content, of the solder according to the present invention, which is an amount within the range of 0.5 to 3.0% by weight relative to the total weight of the composition, serves to improve the solderbility of the solder and also to avoid any possible formation of blowholes in the joint ultimately fromed by the solder. If the silicon content is not more than 0.5% by weight, the solderbility of the solder will be lowered with the increased possiblity of formation of the blowholes in the joint ultimately formed. On the contrary thereto, if the silicon content is less than 3% by weight, the amount of carbon in the solder precipitated during the soldering operation will become so great that the wear resistance and the bondability of the joint ultimately formed by the solder may be lowered.

In addition, the total amount of the carbon and silicon contents in the solder according to the present invention must be at least 4%, preferably within the range of 5 to 7%, by weight relative to the total weight of the composition. If this total amount is not more than 4% by weight, the melting point of the solder will not be less than 1,250° C. and, therefore, when the cutting tips are heated to such a temperature during the soldering operation, the physical strength of these stellite tips is likely to be lowered.

In addition to the foregoing principal components such as carbon, silicon and iron, the solder according to the present invention may contain one or more impurities including manganese, phosphor and/or sulphur.

The solder of the above described composition according to the present invention can be prepared by mixing iron powder, graphite powder and a powder of either silicon or Fe-Si alloy, together with a lubricant such as 1 to 2% by weight of zinc stearate relative to the total weight of the composition, the amount of each of these powders mixed being so selected that the resultant solder will contain 3 to 5% by weight of carbon, 0.5 to 3.0% by weight of silicon and the balance iron and with or without impurities, the total amount of the carbon content and the silicon content being at least 4% by weight. The solder according to the present invention may be actually employed in the form of either a solder compact, and which is prepared by subjecting the above described mixture to a compression molding, or a solder casting which is prepared by melting the above described mixture and then pouring the melted mixture into a mold having a mold cavity of any desired shape.

With respect to the material for the cutting tips to be employed in the manufacture of the drilling bit according to the present invention, a stellite alloy is preferred. However, since the solder of the above described composition has a maximum melting point not more than 1,250° C., the stellite alloy should have a melting point more than 1,250° C and, in addition, should have high hardness at an elevated temperature, a sufficient impact resistance and a sufficient wear resistance. In view of this, the stellite alloy is preferably employed in the form of a Co-matrix alloy and contains 30 to 45% by weight of chromium, 10 to 20% by weight of tungsten, 1.0 to 2.5% by weight of carbon and the balance cobalt, the percent by weight being based on the total weight of the composition.

The bit head, to which the cutting tips of either stellite or super hard alloy are soldered by the use of the solder of the particular composition according to the present invention, may be conventional and is made of ferrous material such as iron or steel.

The super hard alloy, which may be a material for the cutting tips, can be an alloy containing tungsten carbide or titanium carbide or a mixture of these carbides, and which is in turn sintered with cobalt oxide or Ni-Mo alloy.

BRIEF DESCRIPTION OF THE DRAWING

These and other objects and features of the present invention will become apparent from the following description taken in conjunction with preferred embodiments with reference to the accompanying drawings, in which.

DETAILED DESCRIPTION OF THE INVENTION

Figure 1:
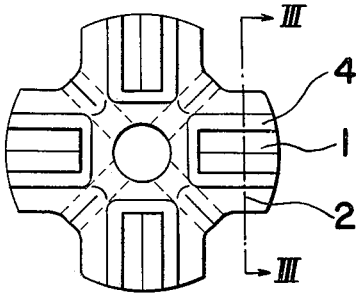
FIG. 1 is an end view of a drilling bit according to one embodiment of the present invention.

Before the description of the present invention proceeds, it is to be noted that like parts are designated by like reference numerals throughout the accompanying drawings.

Figure 2:
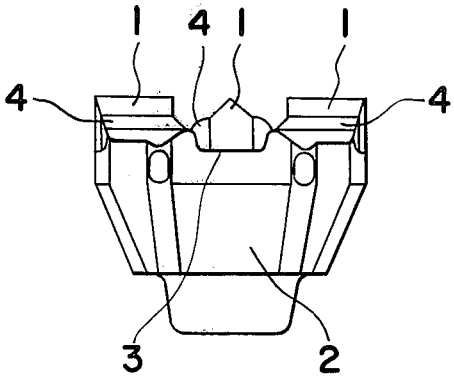
FIG. 2 is a side elevational view of the drilling bit shown in FIG. 1.
Figure 3:
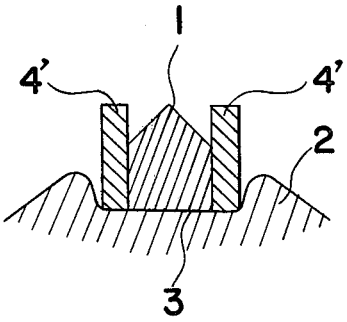
FIG. 3 is a cross sectional view taken along the line III—III in FIG. 1, showing the relative positioning of the solder portions prior to a soldering operation.

Referring first to FIGS. 1 to 3, a drilling bit for use in tapping a taphole in a furnace is shown to comprise a bit head 2 having one end on which a plurality of tips, generally indicated by 1, are rigidly mounted in a manner as will be described later, the other end of said bit head 2 being connected either integrally or detachably to a bit rod (not shown) which is in turn detachably connected to a drilling machine (not shown). The drilling machine, including the bit rod, for making the taphole in the blast furnace and its mounting arrangement relative to the blast furnace are described and shown in the U.S. Pat. No. 3,516,651, patented on June 23, 1970 and assigned to the same assignee of the present invention and, therefore, reference may be made thereto for the details thereof.

As thus far illustrated, the bit head 2 is shown as adapted to be interchangeably mounted on the bit rod through any suitable chuck preferably rigidly mounted on the bit rod at one end thereof remote from the body of the drilling machine. As hereinbefore described, this bit head 2 is made of ferrous material such as iron or steel and is quite conventional. Preferably, the bit head 2 is made of steel of the type specified by S45C according to the Japanese Industrial Standards.

Four tips 1 are illustrated and each is made of a stellite alloy containing 40.2% by weight of carbon, 10.42% by weight of tungsten, 1.83% by weight of carbon and the balance cobalt. Each of these tips 1 is molded by the use of any known metal casting technique into a shape having an outwardly directed 90° beveled cutting edge, the overall dimensions of which is 14 mm. in length, 11 mm. in height (including the edge height of 3.5 mm.) and 7 mm. in width. These tips 1 are placed in corresponding grooves 3 which are 11.5 mm. in width and 4 mm. in depth and which are radially positioned on the one of the bit head 2 in circumferentially spaced relation to each other, each of which grooves 3 extends from an outer peripheral edge of the one end of the bit head 2. Placement of these tips 1 in the corresponding grooves 3 is carried out in such a manner as to allow the outwardly bevelled cutting edges to face outwards in a direction opposed to the bit rod.

The tips 1 so placed are soldered to the bit head 1 by means of respective consecutive joints 4 each filling the clearance between the surface of the head 1 defining the groove 3 and the associated tip 1 seated within such groove 3, as best shown in FIG. 2.

In order to form the consecutive joints 4, solder compacts 4', 11 mm. in length, 2mm. in width and 12.7 mm. in height, are prepared. Preparation of each solder compact 4' is carried out by mixing graphite powder, silicon powder having a particle size not more than 200 mesh and a reduced iron powder having a particle size not more than 200 mesh, for 20 minutes by the use of a conventional mixer of the V-type, the amount of each of the components being so selected that the solder compact ultimately formed contains 4% by weight of carbon, 2% by weight of silicon and the balance iron. The mixture is then compacted by the application of a presure of 3 ton/cm$^2$ while being molded into the desired shape.

The solder compacts 4', are placed in the manner as best shown in FIG. 3 and filling the clearance which is defined in each groove 3 around the associated tip 1 seated within such groove 3, and are heated, together with the bit head 2 having the tips 1 mounted thereon, in an argon containing atmosphere to 1,180° C., then maintained at such temperature for 10 minutes and, thereafter, allowed to stand to cool. By so doing, the solder compacts 4' can be transformed into the corresponding consecutive joints 4 by which the respective tips 1 are rigidly secured to the bit head 2 as shown in FIGS. 1 and 2.

Preferably, soldering is carried out at 1,100° to 1,250° C. for 5 to 30 minutes. If the soldering is continued for more than 30 minutes, the result would be that an intermediate diffusion layer between the tips 1 and the solder compacts 4' becomes thick with a consequent undesirable reduction in temperature which can be withstood by the bit.

As hereinbefore described, according to the present invention, since the tips 1, which are made of stellite alloy and have been molded into a predetermined shape, are soldered to the bit head 2, no grinding process is necessary such as has heretofore been necessary to form the substantially bevel-shaped cutting edge on each of the tips.

Since each of the tips 1 is made of stellite alloy according to the present invention, the substantially bevel-shaped cutting edges of the respective tips may wear during the continued use thereof. In this case, by depositing a pad of the same stellite alloy on the worn tips, the drilling bit can be reused. As hereinbefore described, the tips 1 may alternatively be made of super hard alloy. However, the employment of the stellite alloy is preferred in view of the fact that the drilling bit having the tips made of stellite alloy does not require a higher running cost than that having the tips made of super hard alloy.

Figure 4:
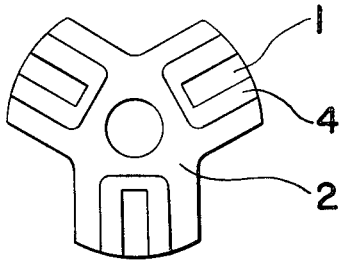
FIG. 4 is a view similar to FIG. 1, showing another preferred embodiment of the present invention.

In the foregoing embodiment, the drilling bit has been described as having four tips 1 radially arranged on the bit head 2. However, the number of the tips 1 may not always be limited to that shown in FIG. 1, but may be three or five or more. An example wherein three tips 1 are employed is shown in FIG. 4.

Figure 5:
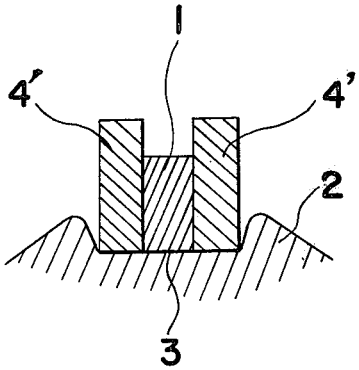
FIG. 5 is a view similar to FIG. 3, showing the relative positioning of the solder portions with respect to a cutting tip having a flat cutting edge.
Figure 6:
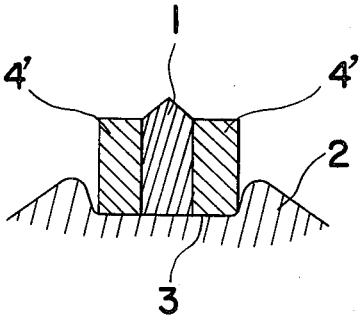
FIG. 6 is a view similar to FIG. 3, showing the relative positioning of the solder portions with respect to a cutting tip having a beveled cutting edge.

FIG. 5 and 6 illustrate respective types of solder compacts used to connect a tip 1 of super hard alloy to the head. In FIG. 5, the solder compacts 4' shown have a length of 11 mm., a width of 4 mm. and a height of 11 mm. and are placed around the tip 1 having rectangular cross-section body, the overall dimension of which tip 1 is 11 mm. in length, 4 mm. in width and 8 mm. in height, one compact 4' on each side of said tip 1. The tip 1 can be soldered to the bit head when the solder compacts 4', together with the tip 1 on the bit head 2, are heated at 1,100° to 1,250° C. for 5 to 30 minutes in the manner as hereinbefore described.

In FIG. 6, the tip 1 is shown to have a substantially bevel-shaped cutting edge, and the overall dimensions are 11 mm. in length, 4 mm. in width and 10 mm. in height. On the other hand, in order for the tip 1 of the above described shape and dimensions to be connected to the bit head 2, the solder compacts 4', 11 mm. in length, 4 mm. in width and 8 mm. in height, are placed around the tip 1, one each side thereof, prior to being heated in the manner as hereinbefore described.

Where each of the tips 1 is made of super hard alloy, the substantially bevel-shaped cutting edge may not always be necessary. However, the edge preparation to form the substantially bevel-shaped cutting edge is recommended to improve the drilling efficiency.

The drilling bit having the tips of super hard alloy secured to the bit head in the manner as hereinbefore described can be used for a substantially long time in making tapholes in the blast furnace with no substantial possiblity of separation of some or all of the tips from the bit head.

Although the present invention has fully been described by way of the preferred embodiments thereof with reference to the accompanying drawings, various changes and modifications will be apparent to those skilled in the art. For example, the shape, size and/or number of the tips and/or the shape and/or size of the solder of the particular composition are not always limited to that shown, but may be suitably selected, for example, depending upon the size of the taphole to be drilled and/or the type of a blast furnace in which the taphole is to be drilled.

Therefore, such changes and modifications are to be construed as included within the true scope of the present invention unless they depart therefrom.

We claim:

1. In a drilling bit for use in making a taphole in a furnace which comprises a bit head of ferrous material and a plurality of cutting tips radially mounted on and soldered to said bit head in spaced relation to each other, the improvement wherein each of said cutting tips is made of a metallic material selected from the group consisting of super hard alloy and stellite and each of said tips is soldered to said bit head by a soldering material containing 3 to 5% by weight of carbon, 0.5 to 3.0% by weight of silicon and the balance iron, said percent by weight being based on the total weight of the composition, the sum of the carbon content and the silicon content in said soldering material being at least 4% by weight relative to the total weight of the composition.

2. A drilling bit as claimed in claim 1, wherein said soldering material has a melting point within the range of 1,100° to 1,250° C.

3. A drilling bit as claimed in claim 1, wherein said metallic material is a super hard alloy.

4. A drilling bit as claimed in claim 3, wherein said soldering material has a melting point within the range of 1,100° to 1,250° C.

5. A drilling bit as claimed in claim 1, wherein said stellite contains 30 to 45% by weight of chromium, 10 to 20% by weight of tungsten, 1.0 to 2.5% by weight of carbon the balance cobalt.

6. A drilling bit as claimed in claim 2, wherein said stellite contains 30 to 45% by weight of chromium, 10 to 20% by weight of tungsten, 1.0 to 2.5% by weight of carbon and the balance cobalt.

7. A drilling bit as claimed in claim 1, wherein each of said tips has a substantially outwardly bevelled cutting edge.

* * * * *